US006053138A

United States Patent [19]

Trzmiel et al.

[11] Patent Number: 6,053,138

[45] Date of Patent: Apr. 25, 2000

[54] DEVICE FOR HYDRAULIC ROTATIONAL ANGLE ADJUSTMENT OF A SHAFT RELATIVE TO A DRIVE WHEEL

[75] Inventors: Alfred Trzmiel, Grafenberg; Wolfgang Stephan, Boll; Axel-Willi Jochim, Nuertingen, all of Germany

[73] Assignees: Hydraulik Ring GmbH; Dr. Ing. h.c.F. Porsche AG, both of Germany

[21] Appl. No.: 09/213,758

[22] Filed: Dec. 17, 1998

[30] Foreign Application Priority Data

Dec. 17, 1997 [DE] Germany ..... 197 56 015

[51] Int. Cl.[7] ..... F01L 1/344

[52] U.S. Cl. ..... 123/90.17; 123/90.31; 74/568 R; 464/2

[58] Field of Search ..... 123/90.12, 90.15, 123/90.17, 90.31; 74/568 R; 464/1, 2, 160

[56] References Cited

U.S. PATENT DOCUMENTS

| | | | |
|---|---|---|---|
| 4,858,572 | 8/1989 | Shirai et al. | 123/90.15 |
| 5,219,313 | 6/1993 | Danieli | 464/2 |
| 5,305,719 | 4/1994 | Clarke et al. | 123/90.17 |
| 5,826,552 | 10/1998 | Noguchi et al. | 123/90.17 |

FOREIGN PATENT DOCUMENTS

| | | |
|---|---|---|
| 0486068 | 5/1992 | European Pat. Off. . |
| 3641769A1 | 6/1987 | Germany . |
| 3937644A1 | 5/1991 | Germany . |
| 4233250 | 1/1994 | Germany . |
| 2302391 | 1/1997 | United Kingdom . |
| 2314402 | 12/1997 | United Kingdom . |

*Primary Examiner*—Wellun Lo
*Attorney, Agent, or Firm*—Evenson, McKeown, Edwards & Lenahan, P.L.L.C.

[57] ABSTRACT

A device for hydraulic rotational angle adjustment of a shaft to a drive wheel, especially the camshaft of an internal combustion engine, has ribs or vanes that are nonrotatably connected with the shaft, said ribs or vanes being located in the compartments of a compartmented wheel. The compartments of the compartmented wheel and the ribs and/or vanes produce pressure chambers by whose hydraulic pressurization the two structural elements can be rotated relative to one another. In order to secure the two structural elements against undesired rotation when an insufficient adjusting or retaining pressure is present, a common end face of the compartmented wheel and of the ribs and/or vanes cooperates with an annular piston that exerts a releasable clamping action on the parts that are rotatable relative to one another.

20 Claims, 3 Drawing Sheets

DEVICE FOR HYDRAULIC ROTATIONAL ANGLE ADJUSTMENT OF A SHAFT RELATIVE TO A DRIVE WHEEL

BACKGROUND AND SUMMARY OF THE INVENTION

This application claims the priority of German application 197 56 015.6, filed in Germany on Dec. 17, 1997, the disclosure of which is expressly incorporated by reference herein.

The invention relates to a device for hydraulic rotational angle adjustment of a shaft relative to a drive wheel, especially the camshaft of an internal combustion engine comprising an inner part that is nonrotatably connected with the camshaft, said inner part having at least approximately radially extending ribs or vanes, and a driven compartmented wheel that has a plurality of compartments distributed around the circumference which are subdivided by the ribs or vanes guided in an angularly movable fashion, into two pressure chambers each, for whose pressurization the inner part is rotated relative to the compartmented wheel, and with means for securing the rotational position of the inner part relative to the compartmented wheel.

A device of this kind is known for example from U.S. Pat. No. 4,858,572. In this device according to the species, an internal part is connected nonrotatably with the end of the camshaft, which has a plurality of radial slots distributed around the circumference on its exterior, in which slots vane elements are guided radially displaceably. This interior part is surrounded by a compartmented wheel that has a plurality of hydraulically loadable compartments divided by the vanes into two pressure chambers opposite one another and acting on these compartments. As a result of the pressurization of these pressure chambers, and as a function of the pressure differential, the compartmented wheel can be rotated relative to the inner part and hence relative to the camshaft. In addition, two hydraulically pressurizable pistons are guided in the compartmented wheel, each in a radial bore a in specified angular position, each piston being capable of being inserted into a radial depression of the inner part in the associated end position of the device. These pistons are urged in the direction of the inner part by compression spring elements and are displaceable in the inner ring in the opposite direction by hydraulic pressurization of the bores. The device is intended to be locked in one of its two end positions by these spring-loaded pistons, provided the pressure for pressurizing the pressure chambers does not reach a certain level. It is only when a certain pressure level is reached that the pistons are pushed back against the action of the compression springs and allow the inner part to turn relative to the compartmented wheel. With such a device, it is intended among other things to avoid rattling noises when starting the internal combustion engine, said noises being caused by changing torque loads when starting and operating the engine.

In addition, the device is to be held in a specific rotational position until the pressure level has reached a value that is sufficient to achieve a reliable holding and adjusting effect. However it is disadvantageous that with such a device, locking is only possible in the end positions of the respective adjustment ranges of the device. Moreover, such an arrangement is costly to manufacture because of the radial bores and requires relatively large rib widths in the compartmented wheel to accept the bores and the piston, thus reducing the width of the compartments and sharply limiting the adjustment range of the device.

A device for hydraulic rotational angle adjustment of a camshaft relative to its drive wheel is known from DE 39 37 644 A1, in which a plurality of radially-extending ribs is permanently attached to an inner part nonrotatably connectable with the camshaft, said ribs being rotationally movably mounted in the compartments of a surrounding compartmented wheel and dividing these compartments into two pressure chambers each. However, means for securing the rotational position of the shaft relative to the compartmented wheel are not provided here.

On the other hand, a goal of the invention is to improve a device for hydraulic rotational angle adjustment of a shaft relative to a drive wheel in such fashion that in every rotational position, a secure fastening of the inner part and/or the shaft relative to the compartmented wheel is made possible, thus reliably preventing unwanted changes in position during operation.

This goal is achieved according to the invention by providing a device wherein the means for securing the rotational position constitutes an annular piston that cooperates with at least one axial end face of the ribs or vanes or of the compartmented wheel.

Because the means for securing the rotational position comprise a hydraulically pressurizable annular piston that abuts a common axial end face of the ribs or vanes of the inner part and of the compartmented wheel, locking and/or clamping is possible in every angular position of the two elements relative to one another. As a result, not only can any desired angular positions of the two structural elements relative to one another be secured, but it is also readily possible, especially when used in the valve drive of an internal combustion engine, to avoid rattling noises when starting the engine which are caused in one of the two end positions of the device by exposure to fluctuating torque. As a result, a clamping action that replaces or supports the hydraulic clamping action can be achieved in all rotational positions and permits operation with greater regulating accuracy.

The device according to the invention also has the advantage of being especially simple in construction and thus can be manufactured economically. Assembly is made much simpler, faster, and hence more inexpensive by eliminating the relatively small pistons and spring elements that are costly to install. Moreover, no additional bores in the ribs of the compartmented wheel are necessary, so that the ribs can be made relatively narrow, hence making possible a greater compartment width and/or a greater compartment angle, and consequently a greater adjustment range of the device, with the same number of compartments.

The annular piston of the device can be made economically as an annular disk.

A device of this kind can be built especially simply and economically if the annular piston is arranged relative to the inner part for securing and/or clamping the compartmented wheel in such fashion that it simultaneously serves as the end seal for the pressure chambers.

The annular piston can be guided and secured in a manner that is favorable for manufacturing techniques by a lid element connected with the compartmented wheel on the side facing away from the pressure chambers.

A reliable locking and/or clamping of the two structural elements that are movable relative to one another, which in particular prevents a change in the rotational position for as long as a sufficient pressure level is not reached in the pressure chambers, is obtained when the annular piston under the influence of a spring element reaches a clamping position against the compartmented wheel and the ribs or vanes of the inner part.

The annular piston and the corresponding piston surfaces are designed in an advantageous manner so that when a pressure level is applied in the pressure chambers that is sufficient for relative displacement of the two structural elements with respect to one another, the clamping action of the annular piston is terminated.

Other objects, advantages and novel features of the present invention will become apparent from the following detailed description of the invention when considered in conjunction with the accompanying drawings.

DETAILED DESCRIPTION OF THE DRAWINGS

Figure 1:
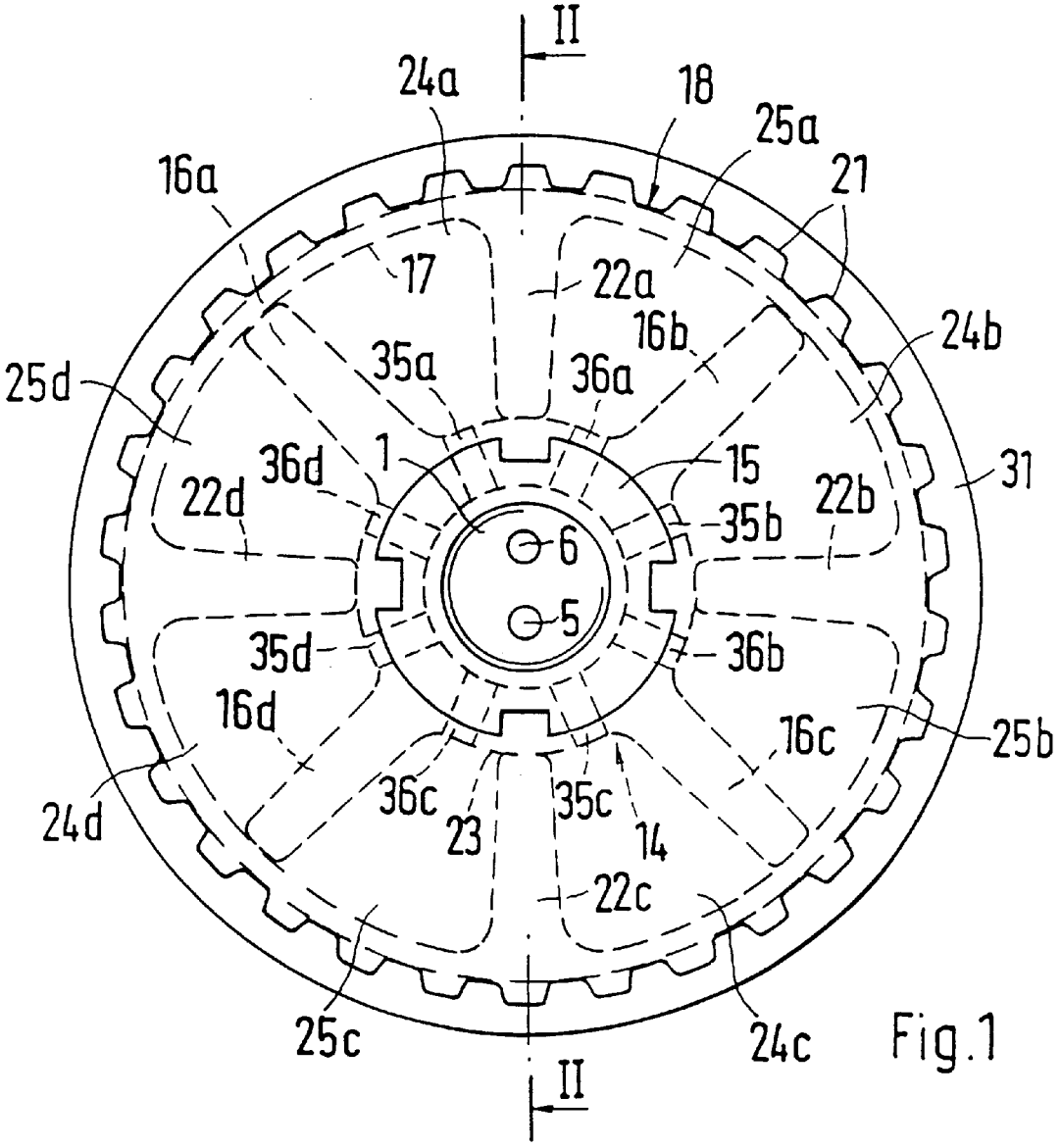
FIG. 1 is a top view as viewed from the end of a camshaft of a device for hydraulic rotational control of an engine camshaft constructed according to a preferred embodiment of the invention.
Figure 2:
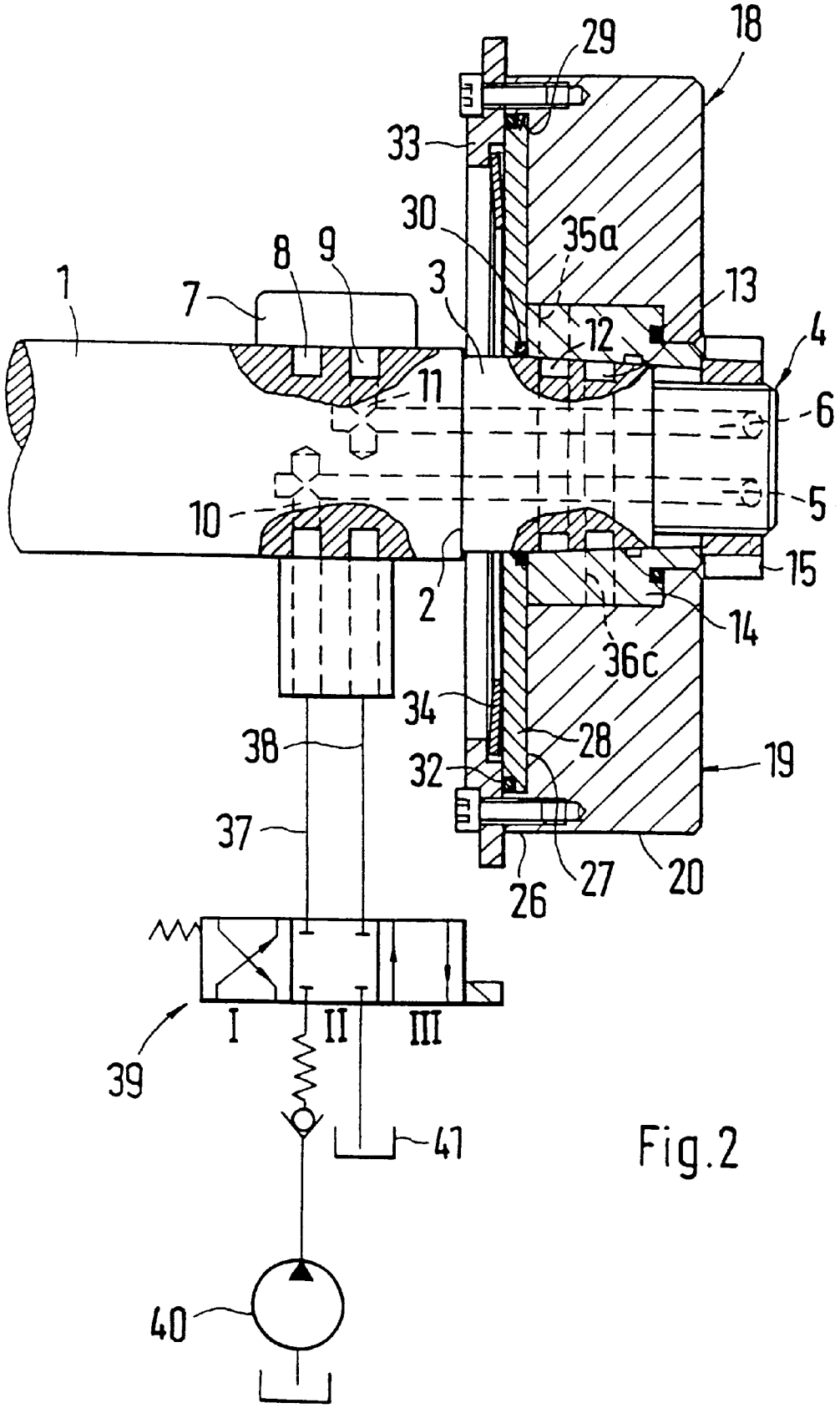
FIG. 2 is a schematic control circuit view with a section along line II—II in FIG. 1.

In FIGS. 1 and 2, 1 represents the camshaft of an internal combustion engine that is known of itself and is not shown in greater detail. This camshaft has at one end a conical section 3 that takes its departure from a circumferential shoulder 2, said section 3 making a transition to a threaded pin 4. Beginning at the free end of this threaded pin 4, two spaced axial bores 5 and 6 closed at the ends are provided in the camshaft, said bores extending into the vicinity of a camshaft bearing 7. In the vicinity of this camshaft bearing 7, camshaft 1 is provided on its outer circumference with two spaced annular grooves 8 and 9, connected by a radial bore 10 and/or 11 with one of the axial bores 5 or 6. In the vicinity of conical section 3 of camshaft 1, two circumferential annular grooves 12 and 13 are likewise provided on its outer circumference, said grooves likewise being connected by radial bores not shown in greater detail with each of the axial bores 5 and 6. Annular groove 12 is connected by the axial bore 5 with annular groove 8 in the vicinity of the camshaft bearing, while annular groove 13 is connected by axial bore 6 with annular groove 9 in the vicinity of the camshaft bearing.

An inner part 14 is mounted on the conical section 3 from the free end of the camshaft, said part 14 being secured by a nut 15 screwed onto threaded pin 4. This nut 15 simultaneously produces a positive connection between the inner part and conical section 3 of the camshaft so that a nonrotatable connection results. From the outer circumference of inner part 14 in this embodiment, four radial ribs 16*a* to 16*d* arranged offset by 90° each extend. These ribs 16*a* to 16*d* have their outer circumferences fitting tightly against the inside 17 of a pot-shaped compartmented wheel 18. This compartmented wheel 18 has a bottom 19 from which a circumferential edge 20 takes its departure, said edge fitting around ribs 16*a* to 16*d*. This circumferential edge 20 is provided on its exterior with teeth 21 that cooperate with a toothed belt, not shown, by which the shaft is driven. However, it is also possible by contrast to drive the compartmented wheel by a chain drive or a gear drive for example.

Four ribs 22*a* to 22*d* offset 900 apart take their departure from the inside of compartmented wheel 18 or surrounding edge 20, said ribs abutting the outer circumference 23 of the inner part with a sealing action and formed by the four compartments of the compartmented wheel. In each compartment, two pressure chambers 24*a* to 24*d* and 25*a* to 25*d* are formed by ribs 16*a* to 16*d* of the inner part and ribs 22*a* to 22*d*, and are limited in the circumferential direction. An annular projection 26 is formed on the side facing away from the shaft end in the compartmented wheel 18 or circumferential edge 20. The ends of ribs 16*a* to 16*d* and 22*a* to 22*d* that face away from the shaft end as well as the area of edge 20 that extends up to the inner circumference of annular projection 26 are made plane and form a common end face 27. A disk 28 that acts as an annular piston abuts this end face 27, said disk extending up to the inner circumference 29 of circumferential edge 26. This disk 28 that acts as an annular piston has its inner circumference extending up to the conical section 3 of the camshaft and is sealed off there with a circumferential seal 30 from the camshaft and the inner part. Disk 28 is secured in the axial direction on the side facing away from the shaft end by a lid element that turns and is connected with the compartmented wheel. This annular lid element in this embodiment is screwed by a plurality of screws distributed around the circumference in the vicinity of annular projection 26 to the compartmented wheel. By means of a circumferential seal 32 on the outer circumference of disk 28, the latter is sealed off from the annular projection 26 and lid element 31. In the lid element, a circumferential shoulder 33 is formed on the inner circumference against which shoulder in this embodiment a spring element 34 abuts in the form of a cup spring. This shoulder rests in the vicinity of its inner circumference endwise against disk 28. Disk 28 is pressed against the common end face 27 by cup spring 34.

Pressure chambers 24*a* to 24*d* are each connected with annular groove 12 by a bore 35*a* to 35*d* that runs radially in inner part 14. Pressure chambers 25*a* to 25*d* are connected in similar fashion, each by a radial bore 36*a* to 36*d* with annular groove 13.

The annular grooves 8 and 9 in camshaft bearing 7 are each connected by a pressure medium line 37 and 38, shown only schematically, with a control valve 39 which in this embodiment is designed as a 4/3-way valve. This control valve 39 is connected on one side with a pressure medium source 40 which can be the lubricant pump when used inside a camshaft drive of an internal combustion engine. On the other hand, control valve 39 is connected with a pressure medium return 41. In the neutral switch position II of the control valve 39, the pressure medium connections between pressure medium source 40 and/or pressure medium return 41 and the respective pressure chambers 24*a* to 24*d* and 25*a* to 25*d* are interrupted.

In switch position I of the control valve, pressure medium source 40 is connected by annular groove 9, axial bore 6, and annular groove 13 with pressure chambers 25*a* to 25*d* while pressure chambers 24*a* to 24*d* are connected by annular groove 12, axial bore 5, and annular groove 8, with pressure medium return 41. If the pressure in pressure chambers 25*a* to 25*d* exceeds a predetermined pressure level because of the connection with the pressure medium source, annular piston 28 is lifted from end face 27 against the action of cup spring 34, so that the inner part rotates relative to the compartmented wheel in the arrangement shown in FIG. 1 and clockwise in the viewing direction because of the pressure differential in the pressure chambers.

In switch position III of the switching valve, the pressurization is reversed so that in this case, when a predetermined pressure level is reached, the inner part is rotated in the reverse direction relative to the compartmented wheel.

The pretensioning of cup spring 34 is designed as a function of the size ratios of the entire device and as a function of the pressurized end face of annular piston 28 so that when a certain operating pressure of the pressure medium supply is reached, it is possible for the disk and/or annular piston to rise, thus allowing the inner part and the compartmented wheel to rotate relative to one anther.

Figure 3:
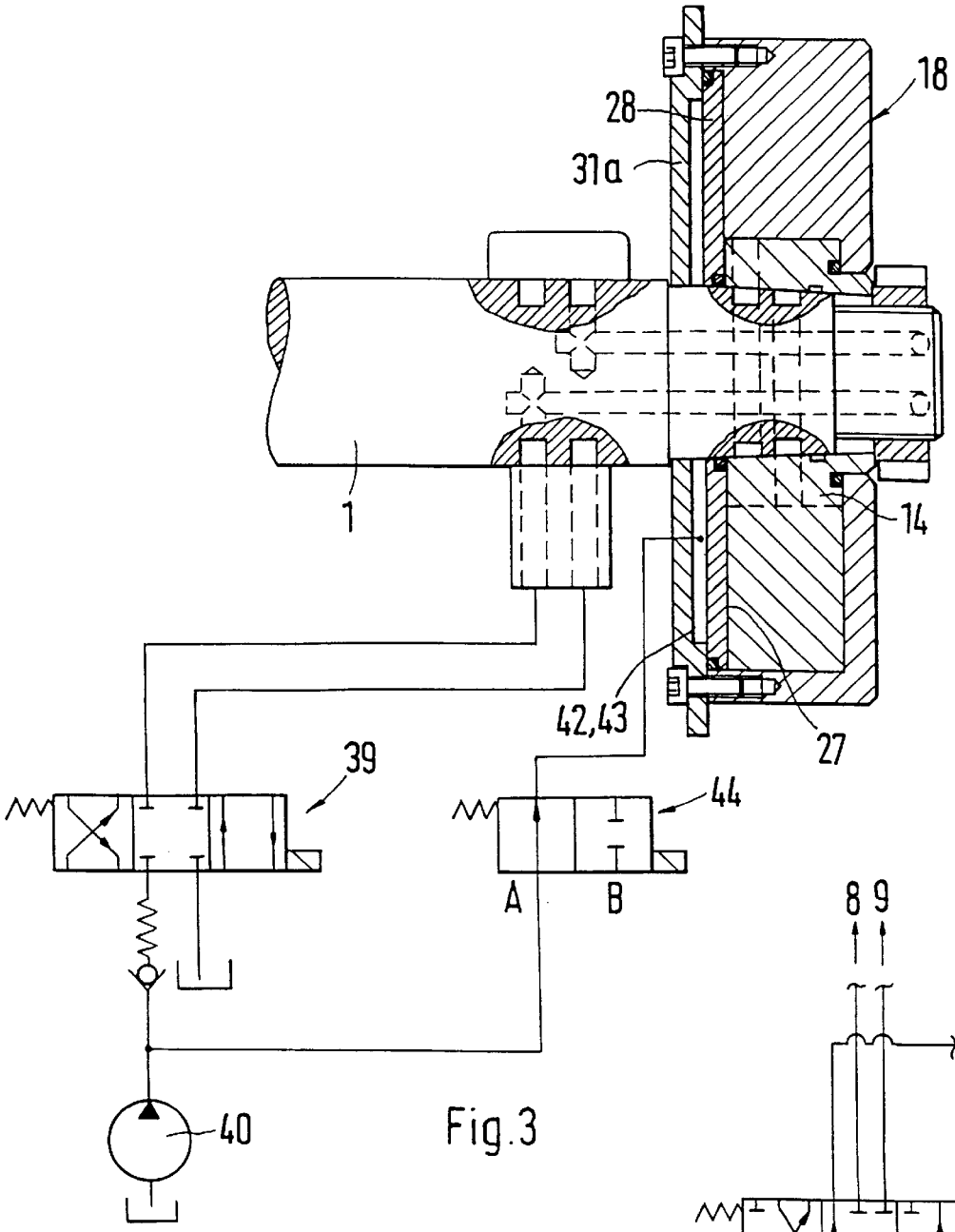
FIG. 3 is a view similar to FIG. 2, showing a second embodiment of the invention.

In contrast thereto, in the embodiment according to FIG. 3 the pressurization on disk 28 that acts as an annular piston is hydraulic on both ends. For this purpose, no compression spring is located on the side of the disk that faces away from the common end face 27, but instead the intermediate space 42 between the disk and the lid element 31*a* that extends up to the camshaft and/or the conical section 3 can be hydraulically pressurized and consequently serves as pressure chamber 43. This pressure chamber 43 is connected through a second control valve 44, which in this embodiment is designed as a 2/2-way valve, with pressure medium source 40.

This second control valve 44 is designed so that in its spring-loaded neutral position A, it opens the connection between pressure chamber 43 and pressure medium source 40 and in its switched position B blocks this connection. With a suitably generously dimensioned effective hydraulic surface of disk 28 that acts as the annular piston relative to this pressure chamber, assurance is provided that, even at very low system pressures, a reliable clamping action is achieved. Rotation of inner part 14 relative to compartmented wheel 18 by actuating first control valve 39, because of a much greater hydraulic effective area on the side facing the pressure chamber, only becomes possible when the second control valve 44 is brought into its locking position B. Then assurance can be provided with suitable pressure monitoring that rotation and/or elimination of the clamping action is only possible when a lower defined pressure level prevails.

Figure 4:
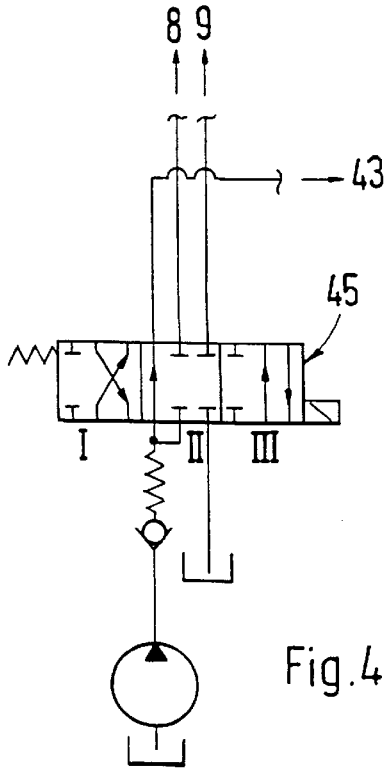
FIG. 4 is a partial schematic view showing a different type of hydraulic control according to preferred embodiments of the invention.

In contrast to the hydraulic control according to the embodiment according to FIG. 3, the hydraulic control according to FIG. 4 is achieved by a control valve 45 into which the function of the second control valve being integrated. Control valve 45 is designed for example as a 6/3-way valve, with the pressure chamber 43 at the disk in the neutral position II of the control valve is constantly pressurized. In the two switch positions I and III of switching valve 45 on the other hand, the pressure medium connection between the pressure medium source and the pressure chamber is interrupted at the annular piston so clamping is released and the inner part can turn relative to the compartmented wheel.

In contrast to the embodiments described previously, the annular piston and/or the disk can also be connected nonrotatably with the ribs or vanes of the inner part or with the compartmented wheel and, to achieve a clamping action, can cooperate only with one face of the respective other part (compartmented wheel or inner part).

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Device for hydraulic rotational angle adjustment of a camshaft to a drive wheel in an internal combustion engine, comprising:

an inner part that is nonrotatably connected with the camshaft, said inner part having radially extending ribs or vanes, and a driven compartmented wheel that has a plurality of compartments distributed around the circumference which are subdivided by the ribs or vanes guided in an angularly movable fashion, into two pressure chambers each, for whose pressurization the inner part is rotated relative to the compartmented wheel, and with means for securing the rotational position of the inner part relative to the compartmented wheel, wherein the means for securing the rotational position constitutes an annular piston that cooperates with at least one axial end face of the ribs or vanes of the compartmented wheel.

2. Device for hydraulic rotational angle adjustment according to claim 1, wherein the at least one axial end face includes a common end face of the ribs or vanes of the compartmented wheel, and wherein the annular piston cooperates with the common end face.

3. Device for hydraulic rotational angle adjustment according to claim 1, wherein the annular piston seals off pressure chambers in the vicinity of the at least one axial end face.

4. Device for hydraulic rotational angle adjustment according to claim 2, wherein the annular piston seals off pressure chambers in the vicinity of the common end face.

5. Device for hydraulic rotational angle adjustment according to claim 1, wherein the annular piston, on a side facing away from the pressure chambers, comes in contact with a lid element connected with the compartmented wheel.

6. Device for hydraulic rotational angle adjustment according to claim 2, wherein the annular piston, on a side facing away from the pressure chambers, comes in contact with a lid element connected with the compartmented wheel.

7. Device for hydraulic rotational angle adjustment according to claim 4, wherein the annular piston, on a side facing away from the pressure chambers, comes in contact with a lid element connected with the compartmented wheel.

8. Device for hydraulic rotational angle adjustment according to claim 1, wherein the annular piston is resiliently biased into a clamping contact with the compartmented wheel and the ribs or vanes under the influence of a spring element.

9. Device for hydraulic rotational angle adjustment according to claim 2, wherein the annular piston is resiliently biased into a clamping contact with the compartmented wheel and the ribs or vanes under the influence of a spring element.

10. Device for hydraulic rotational angle adjustment according to claim 5, wherein the annular piston is resiliently biased into a clamping contact with the compartmented wheel and the ribs or vanes under the influence of a spring element.

11. Device for hydraulic rotational angle adjustment according to claim 7, wherein the annular piston is resiliently biased into a clamping contact with the compartmented wheel and the ribs or vanes under the influence of a spring element.

12. Device for hydraulic rotational angle adjustment according to claim 10, wherein the spring element is designed as a cup spring and is located between the annular piston and the lid element.

13. Device for hydraulic rotational angle adjustment according to claim 11, wherein the spring element is designed as a cup spring and is located between the annular piston and the lid element.

14. Device for hydraulic rotational angle adjustment according to claim 8, wherein the clamping action of the annular piston against the action of the spring element can be eliminated hydraulically by pressurizing some of the pressure chambers.

15. Device for hydraulic rotational angle adjustment according to claim 12, wherein the clamping action of the annular piston against the action of the spring element can be eliminated hydraulically by pressurizing some of the pressure chambers.

16. Device for hydraulic rotational angle adjustment according to claim 1, wherein the annular piston can be brought into clamping contact with the at least one axial end face by hydraulic pressurization on a side facing away from pressure chambers.

17. Device for hydraulic rotational angle adjustment according to claim 2, wherein the annular piston can be brought into clamping contact with the at least one axial end face by hydraulic pressurization on a side facing away from pressure chambers.

18. Device for controlling the relative rotation of a combustion engine camshaft wheel and a control wheel, comprising:

a plurality of radially extending vanes carried by the camshaft wheel and control wheel and defining respective pressure spaces between the vanes, a fluid pressure circuit operable to control pressure supply to the respective pressure spaces to thereby change the relative rotational position of the camshaft wheel and control wheel, and an annular piston selectively engageable with axial ends of the ribs or vanes to exert a releasable clamping action on the parts which are adjustably rotatable with respect to one another.

19. Device for controlling the relative rotation of a combustion engine camshaft wheel and a control wheel according to claim 18, wherein a spring is provided to continuously bias the annular piston toward a clamping position.

20. Device for controlling the relative rotation of a combustion engine camshaft wheel and a control wheel according to claim 18, wherein a pressurizable chamber is provided at an axial side of the annular piston facing away from the ribs or vanes, and wherein the fluid pressure circuit includes a controllable pressure line leading to the pressurizable chamber.

* * * * *